United States Patent [19]

Mussey

[11] 4,301,708

[45] Nov. 24, 1981

[54] LAUNCH TUBE CLOSURE

[75] Inventor: Richard A. Mussey, Springfield, Va.

[73] Assignee: The United States of America as represented by the Secretary of the Navy, Washington, D.C.

[21] Appl. No.: 60,536

[22] Filed: Jul. 25, 1979

[51] Int. Cl.[3] ..... F41F 3/04

[52] U.S. Cl. ..... 89/1.810; 89/1.817

[58] Field of Search ..... 89/1.810, 1.809, 1.8, 89/1.817; 220/319

[56] References Cited

U.S. PATENT DOCUMENTS

| | | | |
|---|---|---|---|
| 413,021 | 10/1889 | Bühring | 220/319 X |
| 2,022,868 | 12/1935 | Nelson | 220/319 X |
| 3,070,254 | 12/1962 | Carse et al. | 220/319 |
| 3,135,163 | 6/1964 | Mechlin et al. | 89/1.810 |
| 3,140,638 | 7/1964 | De Luca | 89/1.817 |
| 3,279,319 | 10/1966 | Semonian et al. | 89/1.810 |
| 3,362,291 | 1/1968 | De Luca | 89/1.817 |
| 3,962,951 | 6/1976 | Schenk | 89/1.810 |

FOREIGN PATENT DOCUMENTS

| | | | |
|---|---|---|---|
| 1002917 | 1/1977 | Canada | 220/319 |

*Primary Examiner*—David H. Brown

*Attorney, Agent, or Firm*—R. S. Sciascia; Sol Sheinbein

[57] ABSTRACT

A closure for a missile launch tube comprising frangible glass ribs mounted on a support ring of the tube to form a dome shaped closure. The ribs are joined to one another externally of and on the longitudinal axis of the launch tube, and a plastic or polymeric cover is mounted on and encloses the glass ribs. The external surface of the plastic cover is provided with a linear-shaped explosive charge and detonator. When the missile begins to move in the launch tube, the detonator is fired to detonate the linear-shaped explosive charge which cuts the plastic and fragments the glass ribs into small granules. The missile may then exit the launch tube without obstruction.

10 Claims, 9 Drawing Figures

LAUNCH TUBE CLOSURE

BACKGROUND OF THE INVENTION

The present invention relates to a closure for a missile launching tube and more particularly to a frangible missile tube closure.

Launch tube closures may be used as a sealing means in conjunction with an outer hatch for the launching of missiles from a submerged or underground missile launcher. The closures may also be used as an environmental closure on launch tubes of surface, ground or air launched missiles. In either case, the closure is designed to be removed prior to launching of the missile.

Prior art launch tube closures include flat plastic diaphragms with explosive cord arranged along a predetermined pattern, Mechlin, Jr. et al, U.S. Pat. No. 3,135,163. The explosive cord is detonated to rupture the diaphragm into several pieces prior to missile launch. A similar type of launch closure employs a thin frangible plastic diaphgram placed over the launch tube so as to be ruptured by the missile as the missile exits the launch tube, Kroh, U.S. Pat. No. 3,742,814. One drawback of these types of closure is that the thin nature of the diaphragm prevents the closure from being used with submerged or underground launch tubes due to the high differential pressures encountered.

Another launch tube closure, Schenk, U.S. Pat. No. 3,962,951, is a dome shaped closure formed of asbestoes reinforced phenolic plastic with plastic foam or other strengthening material between the phenolic plastic dome and the missile. A linear shaped charge is again provided to cut the plastic dome. The disadvantage of this type closure is that the missile must cam back the reinforced phenolic plastic and strengthening material as the missile exits the launch tube. The camming action places a front end load on the missile which may later affect the missile trajectory.

OBJECTS OF THE INVENTION

An object of the invention is to provide a launch tube closure that can be easily ruptured prior to launching of the missile.

Another object of the invention is to provide a closure that reduces front end loading on the missile as the missile exits the launching tube.

A further object of the invention is to provide a launch tube closure that will not impede the exiting of the missile from a launch tube.

A still further object of the invention is to provide a closure of sufficient strength to withstand the differential pressures encountered in a submerged or underground missile launch.

Another object of the invention is to provide a closure that does not require rupture of the closure by the missile as the missile exits the launch tube.

SUMMARY OF THE INVENTION

Accordingly, the foregoing and other objects are attained by providing a closure for a missile launch tube with a plurality of arcuate shaped frangible glass ribs mounted on a support ring of a missile launch tube so as to form a dome shaped closure. The glass ribs are joined to one another at a joint externally of and on the longitudinal axis of the launch tube so as to form the dome shape of the closure. A plastic or other polymeric cover is mounted over the ribs to form the closure skin. The plastic cover extends out beyond the glass ribs and over the support ring so that both the glass ribs and the plastic cover are held on the support ring by an attachment ring.

The external surface of the plastic cover is provided with a linear-shaped explosive charge arranged in an "S" configuration. The charge bisects the dome and encircles the dome circumference so as to rupture the dome prior to launching of the missile. One or more detonators with redundant parallel firing circuits are provided for detonation of the charge prior to launching of the missile.

When the missile is launched, the detonator is fired as the missile first begins to move. The detonator initiates firing of the linear-shaped charge which cuts or ruptures the plastic cover and fragments the frangible glass ribs into very small granules. This allows the missile to exit from the launch tube unobstructed by the plastic cover or glass ribs.

A second embodiment of the invention discloses a closure wherein the entire dome is formed of frangible glass. The glass ribs, rib joint and plastic cover are replaced with a unitary dome of frangible glass. A linear-shaped explosive charge arranged in an "S" shape is provided on the external surface of the dome for fragmenting of the glass dome on launching of the missile.

BRIEF DESCRIPTION OF THE DRAWINGS

A more complete appreciation of the invention and many of the attendant advantages thereof will be readily appreciated as the same becomes better understood by reference to the following detailed description when considered in conjunction with the accompanying drawings in which like reference numerals designate like parts throughout the figures and wherein.

DESCRIPTION OF THE PREFERRED EMBODIMENTS

Figure 1:
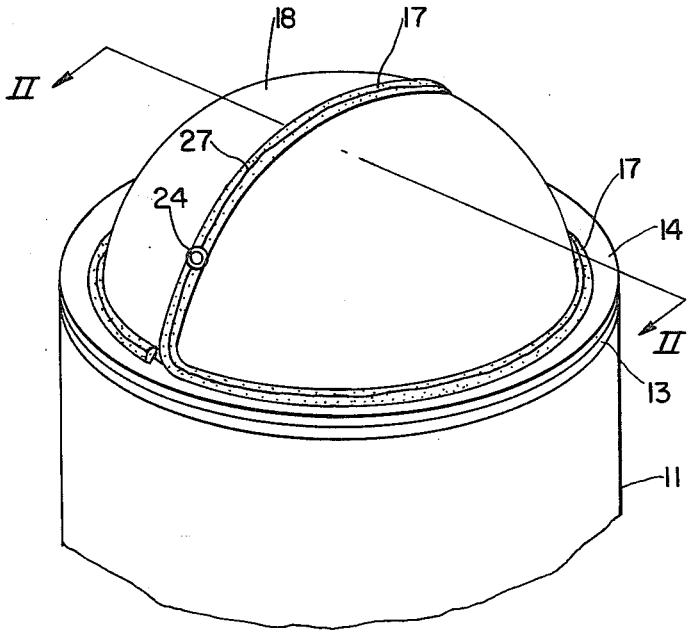
FIG. 1 shows an isometric view of the closure.
Figure 2:
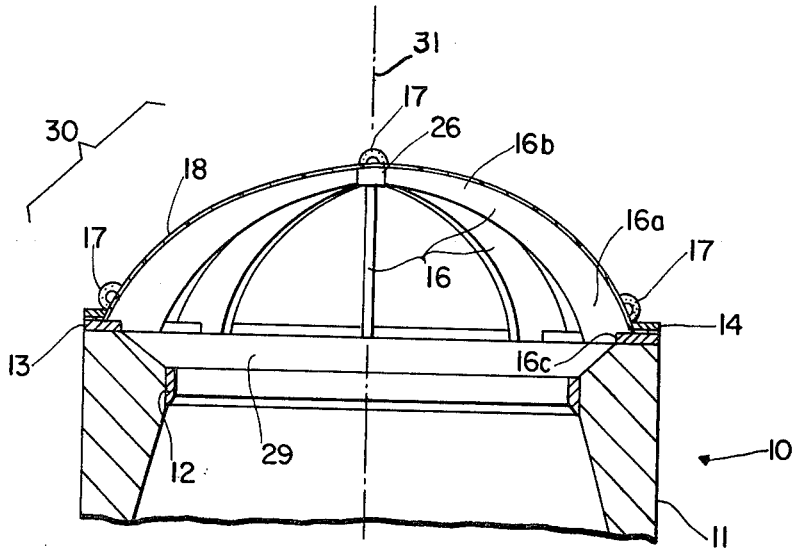
FIG. 2 shows a side cross-sectional view of the closure along line II–II' of FIG. 1.

Referring to FIGS. 1 and 2 of the drawings, there is shown a cylindrically shaped missile launch tube assembly 10 with longitudinal axis 31. Tube assembly 10 is fitted with closure 30 of the subject invention. The launch tube illustrated is in the vertical position but it is contemplated that the closure may be used on horizontal or canted launch tubes.

Launch tube 10 has tube body 11 with muzzle seal 12 fitted on the internal circumference of tube body 11 axially inward adjacent exit muzzle 29 of the tube body. Support ring 13 is permanently mounted on tube body 11 so as to be outward of muzzle seal 12 and circumferentially adjacent to exit muzzle 29. The closure of the subject invention is mounted on support ring 13.

Figure 3:
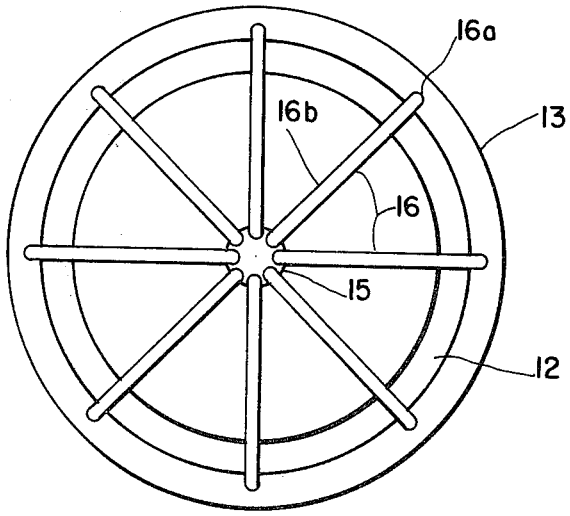
FIG. 3 shows a top plan view of the closure with the plastic cover removed.
Figure 4:
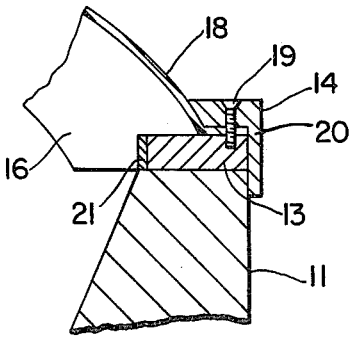
FIG. 4 shows an enlarged cross-sectional view of the attachment means illustrated in FIG. 3.

As illustrated in FIGS. 2 and 3, closure assembly 30 is formed by a plurality of arcuate shaped, frangible glass ribs 16. Ribs 16 are wide in axial width at ends 16*a* and taper gradually to a lesser axial width at ends 16*b*. As seen in FIG. 3, ribs 16 have a uniform transverse width. Wide ends 16*a* have mounting notches 16*c* for mounting each of the plurality of ribs 16 on support ring 13. Ribs 16 may be mounted directly on support ring 13 or may be mounted with foam filler 21 between the ribs and the support ring, as shown in FIG. 4. Glass ribs 16 may be made of any highly frangible glass composition.

When ribs 16 are positioned on support ring 13 by means of mounting notches 16*c*, axially narrow ends 16*b* extend radially inward and axially outward of tube body 11 so as to form a dome shaped closure over the exit muzzle. Ends 16*b* are joined on longitudinal axis 31 by joining means 15, to be described hereinafter in more detail.

Plastic cover 18 covers the dome shape formed by ribs 16 so as to enclose the dome shaped closure. As illustrated in FIG. 4, the outer circumference 20 of cover 18 extends radially outward past the joining of wide ends 16*a* of ribs 16 and support ring 13 so as to seal the joint between the support ring and the ribs.

Ribs 16 and cover 18 are attached to the support ring by circular attachment ring 14. Attachment ring 14 is L-shaped in cross-section with the long leg portion directed axially on the launch tube and the short leg portion directed radially inward on support ring 13 so as to abut outer circumference 20 of plastic cover 18. The radially inward edge of attachment ring 14 is beveled to conform to the profile of the ribs 16 as they join support ring 13. Attachment ring 14 is attached to support ring 13 by a plurality of threaded fasteners 19 so as to hold ribs 16 and the plastic cover 18 to support ring 13. Ribs 16 and cover 18 are thus clamped between attachment ring 14 and support ring 13. It is contemplated that any attachment means that is well known in the art could be substituted for attachment ring 14 and threaded fasteners 19.

Figure 5:
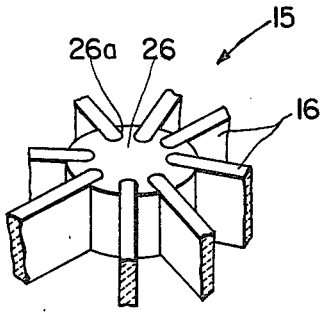
FIG. 5 shows an enlarged isometric view of the rib joint illustrated in FIG. 3.
Figure 6:
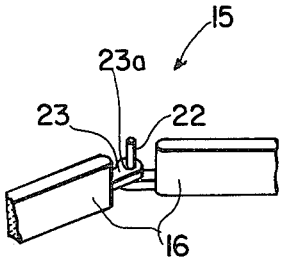
FIG. 6 shows another embodiment of rib joint.

Referring now to FIGS. 5 and 6, joining means 15 will now be described in more detail. FIG. 5 illustrates one type of joining means in the form of cylindrical member 26. A plurality of longitudinally extending notches 26*a* are formed in the cylindrical surface of cylindrical member 26. The axially narrow ends 16*b* of ribs 16 are press fit in the notches 26*a* as the ribs are positioned on support ring 13. With this type of joining means, the ribs 16 are interchangeable and may be fitted into any notch 26*a*.

FIG. 6 illustrates an alternative joining means. Each rib 16, at the axially narrow end 16*b*, is fitted with a tab extension 23 having an axially extending through hole 23*a*. The ribs 16 are then fastened together sequentially by threaded fastener 22.

Figure 7:
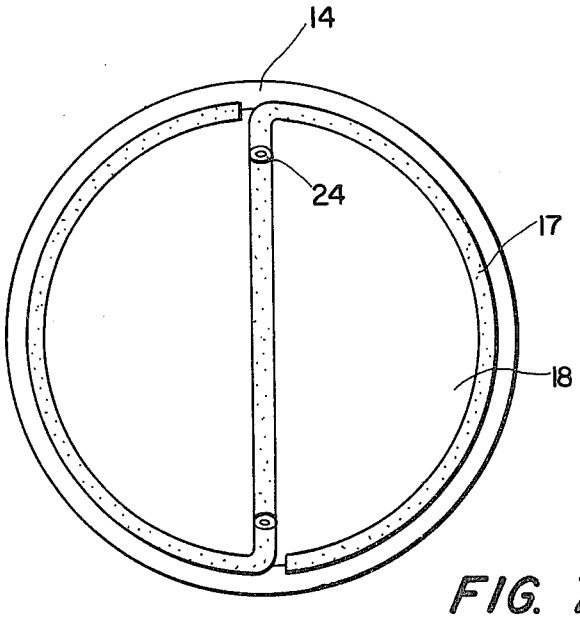
FIG. 7 shows a top plan view of the launch tube closure.

Referring now to FIGS. 1 and 7, plastic cover 18 is held on ribs 16 by attachment ring 14. Linear-shaped explosive charge 17 is arranged in an "S" shape over the domed closure formed by cover 18. The charge may be attached to cover 18 by tape or other suitable attachment means. Any type of explosive charge such as low energy detonating cord or mild detonating fuse may be used. The charge selected must be large enough to rupture cover 18 and fragment ribs 16 without damaging the missile. Explosive charge 17 is provided with one or more detonators 24 for initiating the charge.

Figure 8:
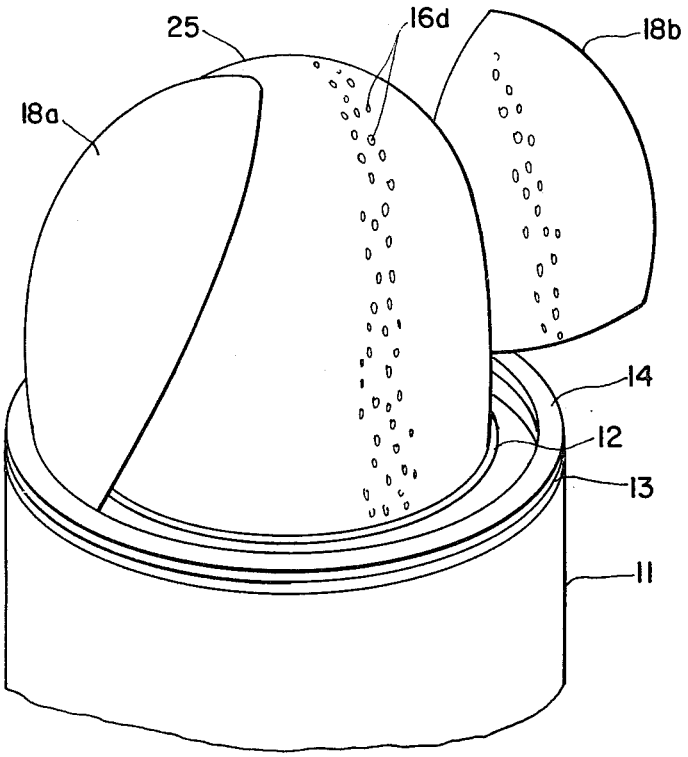
FIG. 8 shows an isometric view of the missile exiting the launch tube.

FIG. 8 shows missile 25 exiting launch tube 11. Cover 18 has been ruptured into pieces 18*a* and 18*b* and severed from the closure by the explosive charge 17. Ribs 16 have been fragmented into granules 16*d*.

Figure 9:
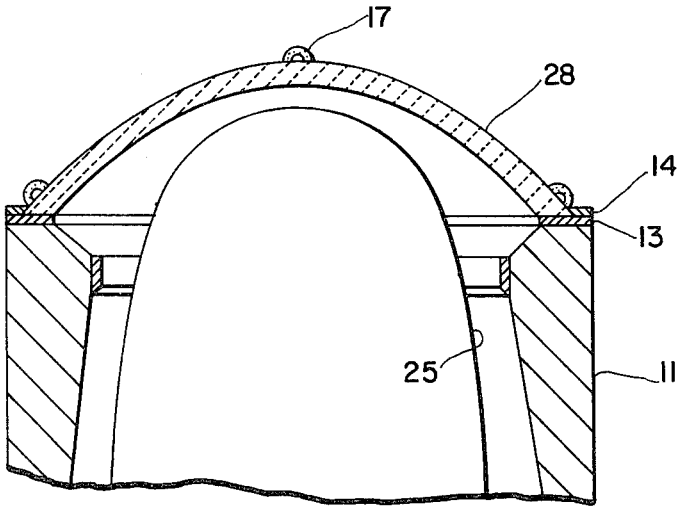
FIG. 9 shows a side cross-sectional view of an alternate embodiment of the closure.

A second embodiment of the invention is illustrated in FIG. 9. The frangible glass ribs 16 and plastic cover 18 have been replaced with a unitary frangible glass dome 28. The glass dome is attached to support ring 13 by attachment ring 14 and threaded fasteners. The glass dome is fitted with a linear-shaped explosive charge 17 and detonators 24 (not shown). Upon firing of the detonators and charge, the unitary dome closure is fragmented into small granules thus enabling missile 25 to exit launch tube 11.

It is thus apparent that the disclosed closure for missile launch tubes can be ruptured prior to the missile exiting the launch tube, reduces front end loading on the missile, can withstand differential pressures encountered in a submerged launch and will not impede exiting of the missile from the launch tube.

Obviously, many modifications and embodiments of the specific invention, other than those set forth above, will readily come to mind to one skilled in the art having the benefit of the teachings presented in the foregoing description and the accompanying drawings of the subject invention and hence it is to be understood that the invention is not limited thereto and that such modifications are intended to be included within the scope of the appended claims.

I claim:

1. A closure for a missile launch tube comprising:

frangible glass means mounted on said launch tube so as to form a dome shaped closure, said frangible glass means comprising:

a plurality of arcuate shaped glass ribs forming a dome shape;

means for joining said glass ribs; and a plastic cover support by and covering said glass ribs and joining means;

means for securing said frangible glass means to said launch tube; and explosive means mounted on said dome shaped closure so as to fragment said frangible glass means prior to missile launch.

2. A closure as in claim 1 wherein said explosive means comprises:

a linear-shaped explosive charge arranged in a predetermined pattern; and means for igniting said explosive charge.

3. A closure as in claim 1 wherein said securing means comprises:

an L-shaped circular attachment ring; and a plurality of threaded fasteners positioned in said attachment ring and in said launch tube so as to secure said frangible glass dome forming means between said attachment ring and said launch tube.

4. A closure as in claim 1 wherein said joining means comprises:

a cylindrical member; and a plurality of longitudinal notches in said cylindrical member for receiving said narrow ends of said glass ribs.

5. A closure as in claim 1 wherein said joining means comprises;

a joining tab extending from said narrow end of each of said glass ribs;

a through hole in each tab; and a threaded fastener for joining said tabs by means of said through holes.

6. A closure as in claim 1 wherein said frangible glass means is a unitary glass dome.

7. A closure as in claim 6 wherein said explosive means comprises:

a linear-shaped explosive charge arranged in a predetermined pattern; and means for igniting said explosive charge.

8. A closure as in claim 1 wherein each of said glass ribs comprises:

a narrow end for joining at said joining means;

a wide end for mounting on said launch tube; and a mounting notch in said wide end for engaging said launch tube.

9. A closure as in claim 8 wherein said plastic cover has an outer circumference which extends radially outward so as to cover said wide ends of said ribs and said launch tube.

10. A closure as in claim 8 further including foam filler inserted between said wide ends of said glass ribs and said launch tube.

* * * * *